US007013531B2

(12) United States Patent
Jackson

(10) Patent No.: US 7,013,531 B2
(45) Date of Patent: Mar. 21, 2006

(54) GRAVITY ACTUATED HINGE ASSEMBLY

(75) Inventor: B. Stewart Jackson, Spartanburg, SC (US)

(73) Assignee: Bommer Industries, Inc., Landrum, SC (US)

( * ) Notice: Subject to any disclaimer, the term of this patent is extended or adjusted under 35 U.S.C. 154(b) by 51 days.

(21) Appl. No.: 10/791,402

(22) Filed: Mar. 2, 2004

(65) Prior Publication Data

US 2005/0193522 A1 Sep. 8, 2005

(51) Int. Cl.
*E05F 1/02* (2006.01)

(52) U.S. Cl. ..... 16/309; 16/382

(58) Field of Classification Search ..... 16/309, 16/312–316, 318, 382, 252, 86.1, 378, 230, 16/231; 49/237, 239, 397, 399, 381; 160/199, 160/196.1
See application file for complete search history.

(56) References Cited

U.S. PATENT DOCUMENTS

| | | | | | |
|---|---|---|---|---|---|
| 2,904,824 | A | * | 9/1959 | Kuehl | 16/318 |
| 3,083,402 | A | * | 4/1963 | Foltz | 16/318 |
| 3,113,649 | A | * | 12/1963 | Wargo | 49/239 |
| 3,292,204 | A | * | 12/1966 | Tansey | 16/263 |
| 3,378,881 | A | * | 4/1968 | Hentzi et al. | 16/312 |
| 3,398,487 | A | * | 8/1968 | Matyas | 49/239 |
| 3,546,736 | A | * | 12/1970 | Booth | 16/312 |
| 3,648,327 | A | * | 3/1972 | Edeus | 16/236 |
| 3,733,650 | A | * | 5/1973 | Douglas | 16/312 |
| 3,748,688 | A | | 7/1973 | Berkowitz | |
| 4,030,161 | A | | 6/1977 | Loikitz | |
| 4,070,728 | A | * | 1/1978 | Herman | 16/243 |
| 4,113,194 | A | * | 9/1978 | Hensley | 242/483.7 |
| 4,215,449 | A | | 8/1980 | Loikitz | |
| 4,253,275 | A | | 3/1981 | Killough | |
| 4,502,183 | A | | 3/1985 | Clancy, Jr. | |
| 4,631,777 | A | | 12/1986 | Takimoto | |
| 4,697,306 | A | | 10/1987 | Rhodes | |
| 4,864,691 | A | * | 9/1989 | Gidseg et al. | 16/312 |
| 4,991,259 | A | | 2/1991 | Finkelstein et al. | |
| 5,265,311 | A | * | 11/1993 | Gard | 16/312 |
| 2002/0116788 | A1 | | 8/2002 | Pompei | |

FOREIGN PATENT DOCUMENTS

| | | | |
|---|---|---|---|
| EP | 777027 | A1 * | 6/1997 |
| GB | 2 038 404 | A | 7/1980 |
| GB | 2359114 | A * | 8/2001 |
| JP | 05086767 | A * | 4/1993 |
| JP | 08074468 | A * | 3/1996 |
| JP | 2000080853 | A * | 3/2000 |
| JP | 2001207720 | A * | 8/2001 |
| JP | 2004239010 | A * | 8/2004 |

* cited by examiner

*Primary Examiner*—Chuck Y. Mah
(74) *Attorney, Agent, or Firm*—J.M. Robertson Intellectual Prop. LLC

(57) ABSTRACT

Gravity hinge assembly which does not rely upon an axial rod or pintle to maintain axial alignment between the cam cylinders. The assembly incorporates an inter-connective attachment arrangement between the upper rotating cam cylinder and the door connection plate to form a simplified operative connection between the door and the upper cam cylinder while maintaining axial stability.

17 Claims, 2 Drawing Sheets

GRAVITY ACTUATED HINGE ASSEMBLY

TECHNICAL FIELD

This invention relates to a hinge assembly and more particularly to a gravity actuated hinge utilizing an arrangement of cam surfaces which are displaceable upon movement of a supported door assembly. The cam surfaces return to a predetermined position upon release of such door assembly so as to provide self-actuated return of the door assembly to such predetermined position. A construction method for the hinge assembly is also provided.

BACKGROUND OF THE INVENTION

Gravity door hinges are well known in the art. Such hinges typically include a fixed cam cylinder member having an inclined cam surface on its upper end and a rotatably and vertically displaceable cam cylinder member including a complementary cam surface on its lower end. An axial rod is inserted through the cam cylinder members such that the two inclined cam surfaces abut each other in a complementary relationship. The rotational cam member is operatively connected to a door such that when the door is opened by pushing or pulling, the door is slightly raised as the upper cylinder member is rotated relative to the lower cylinder member and the angled cam surfaces are brought out of complementary aligned relationship. As a consequence, when the pushing or pulling force is relieved, gravity causes the upper cam surface to retreat to its original complementary orientation relative to the lower stable cam surface.

In order to achieve the desired cooperative relationship between the cam surfaces of the prior hinge structures while also promoting extended useful life without failure, it has been necessary to utilize finely machined and heat treated metallic cylinder elements which are tapped to accept and retain the connecting axial rod in a stable orientation. The use of such manufacturing processes gives rise to substantial complexity in the assembly process. In addition, over a period of prolonged use, heat treated metallic materials may be susceptible to deformation. In particular, the cam surfaces may become abraded thereby resulting in edge deformities reducing the smoothness of the opening and closing operation. Moreover, if the axial rod itself is damaged, then the ability to achieve aligned rotation may be hindered or lost.

SUMMARY OF THE INVENTION

The present invention provides advantages and alternatives over the prior art by providing a gravity actuated hinge assembly which does not rely upon an axial rod or pintle to maintain axial alignment between the cam cylinders. In addition, the cam cylinders are formed from self-lubricating polymeric materials such that abrasion and consequent deformation is greatly reduced. The present invention also incorporates an inter-connective attachment arrangement between the upper rotating cam cylinder and the door connection plate to form a simplified operative connection between the door and the upper cam cylinder. The selection of cylinder cam materials further aides in simplifying the connection of the stationary lower cam cylinder in place relative to a supporting mounting bracket.

According to one aspect of the present invention, a gravity actuated hinge assembly is provided including a complementary pair of self-lubricating cam cylinders formed from a polymeric material such as nylon or the like infused with a friction activated lubricant such as molybdenum, graphite, or the like. The upper cam cylinder is displaceable relative to the lower cam cylinder upon rotation of an operatively attached door such that the upper cam cylinder is raised away from the lower cam cylinder when the door is moved. The upper cam cylinder is operatively connected to the door by a plate assembly embedded in seated relation in a depression within the head of the upper cam cylinder such that direct axial translation between the door and the upper cam cylinder is communicated through the connection plate.

It is to be understood that other aspects, advantages, and features of the invention will become apparent through a reading of the following detailed description of the invention and/or through use of the invention. Accordingly, such description is to be understood to be exemplary and explanatory only and in no event is the invention to be limited to any illustrated and described embodiments. On the contrary, it is intended that the present invention shall extend to all alternatives and modifications as may embrace the principals of this invention within the true spirit and scope thereof.

BRIEF DESCRIPTION OF THE DRAWINGS

The present invention will now be described by way of example only, with reference to the accompanying drawings which are incorporated in and which constitute a part of this specification herein and together with the general description of the invention given above, and the detailed description set forth below, serve to explain the principles of the invention wherein.

DETAILED DESCRIPTION

Figure 1:
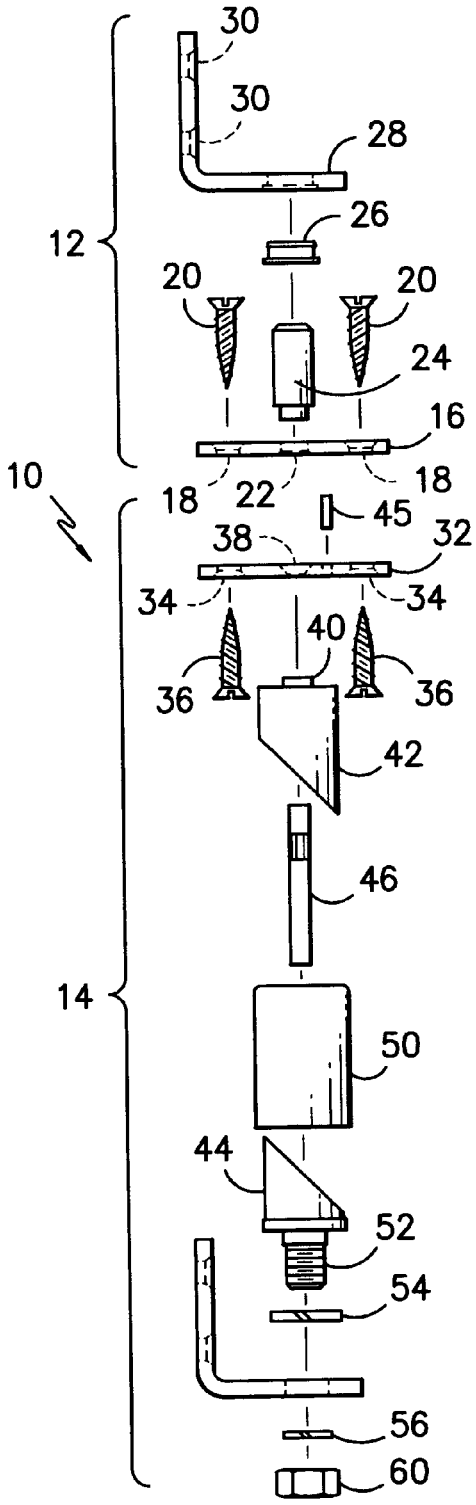
FIG. -1- PRIOR ART
FIG. 1 is an exploded view of a prior art gravity actuated hinge assembly.

Reference will now be made to the drawings wherein, to the extent possible, like reference numerals are utilized to designate corresponding components throughout the various views. For reference purposes only, in FIG. 1 there is illustrated an exemplary prior art gravity actuated hinge assembly 10. As will be appreciated, the hinge assembly 10 includes an upper pivot portion 12 providing a rotatable attachment between a support wall and an upper portion of a swinging door in a manner as will be well know to those with skill in the art. The hinge assembly 10 further includes a lower pivot portion 14 which is likewise adapted to provide a hinging connection between a lower portion of the door and the support wall.

As illustrated, the upper pivot portion 12 includes an upper connection plate 16 including a pair of screw acceptance openings 18 sized to receive attachment screws 20 therethrough such that the screws 20 affix the connection plate 16 to a surface of a swinging door (not shown). As shown, the screw acceptance openings 18 are preferably flared at the upper surface of the connection plate 16 so as to permit the screws 20 to be installed flush with the upper surface. The upper connection plate 16 also includes a stud acceptance opening 22 adapted for receipt and retention of a reduced diameter portion of a stud element 24. The stud element 24 has a substantially cylindrical configuration including a chamfered upper edge such that it can ride in sliding relation within a split bushing 26 which is held in place within a leg of top pivot bracket 28. The top pivot bracket 28 may be secured to a support wall (not shown) by screws projecting through bracket openings 30. As will be appreciated, the construction of the upper pivot portion 12 is such that an attached door may be slightly raised and lowered by application of appropriate force with such change in elevation resulting in a sliding repositioning of the stud element 24 while the top pivot bracket 28 remains stationary.

In the prior art construction, the lower pivot portion 14 includes a lower connection plate 32 including screw acceptance openings 34 adapted to receive screws 36 for insertion in fixed relation to a lower portion of a hinging door structure (now shown). The lower connection plate further includes an acceptance opening 38 for acceptance of an upwardly projecting nipple 40 disposed on the upper surface of a rotating cam cylinder 42. A roll pin 45 extends across the lower connection plate 32 and into the upper surface of the rotating cam cylinder 42 such that rotation of the lower connection plate 32 as the door is pivoted is translated to the rotating cam cylinder 42.

In the prior art device the rotating cam cylinder 42 is held in axial alignment with a complementary stationary cam cylinder 44 by an axial rod or pintle 46 which extends between tapped axial acceptance openings within the caming surfaces of the cam cylinders. A containment sleeve 50 provides additional support against transverse dislocation. The stationary cam cylinder 44 includes an outwardly projecting threaded nipple 52 which projects through a pair of corresponding lock washers 54, 56. The stationary cam cylinder 44 is thereafter held in place by a cooperating nut 58.

As previously explained, when the attached door is rotated, the rotating cam cylinder 42 is caused to rotate relative to the stationary cam cylinder 44 thereby causing the rotating cam cylinder 42 and the attached door to slightly rise. This rise in the door is accommodated at the upper pivot portion 12 by the stud element 24 sliding upwardly through the bushing 26. Once the pushing or pulling force which has opened the door is released, gravity causes the rotating cam cylinder 42 to fall back to its standard position with its caming surface in complementary planer relation with the caming surface of the stationary cam cylinder 44.

While the hinge structure of the prior art illustrated in FIG. 1 is highly reliable, its manufacture and assembly is relatively complex and requires a substantial degree of skill. The present invention provides the functional benefits of the prior art construction while simultaneously eliminating substantial complexity and reducing the overall number of components required.

Figure 2:
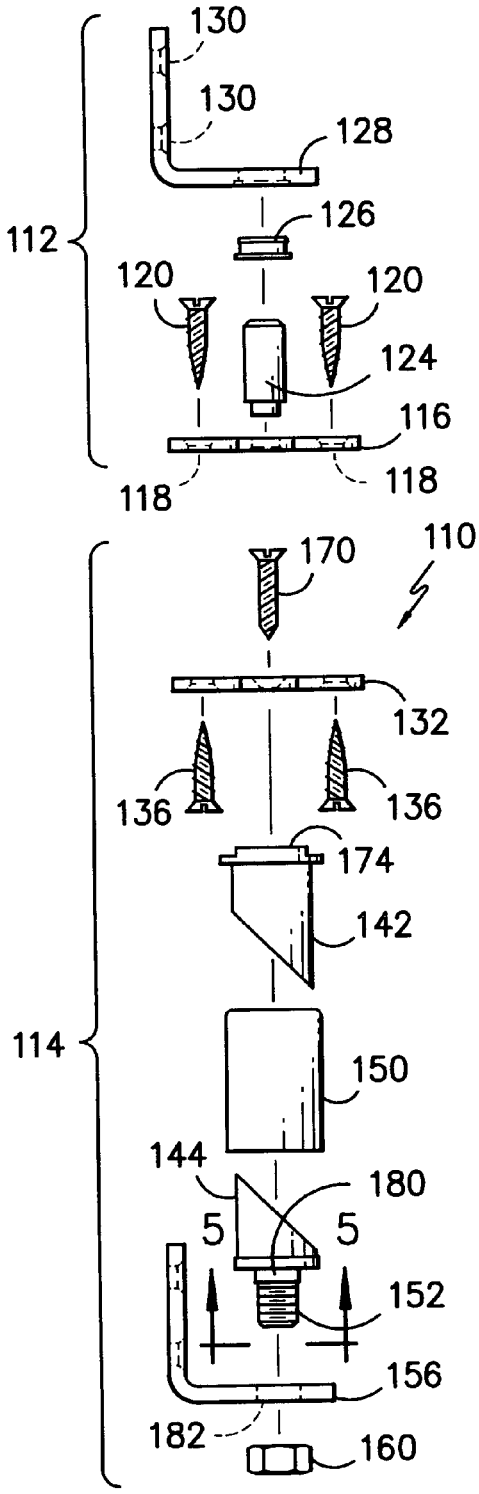
FIG. 2 is a view similar to FIG. 1 illustrating an exemplary embodiment of a gravity actuated hinge assembly according to the present invention.
Figure 3:
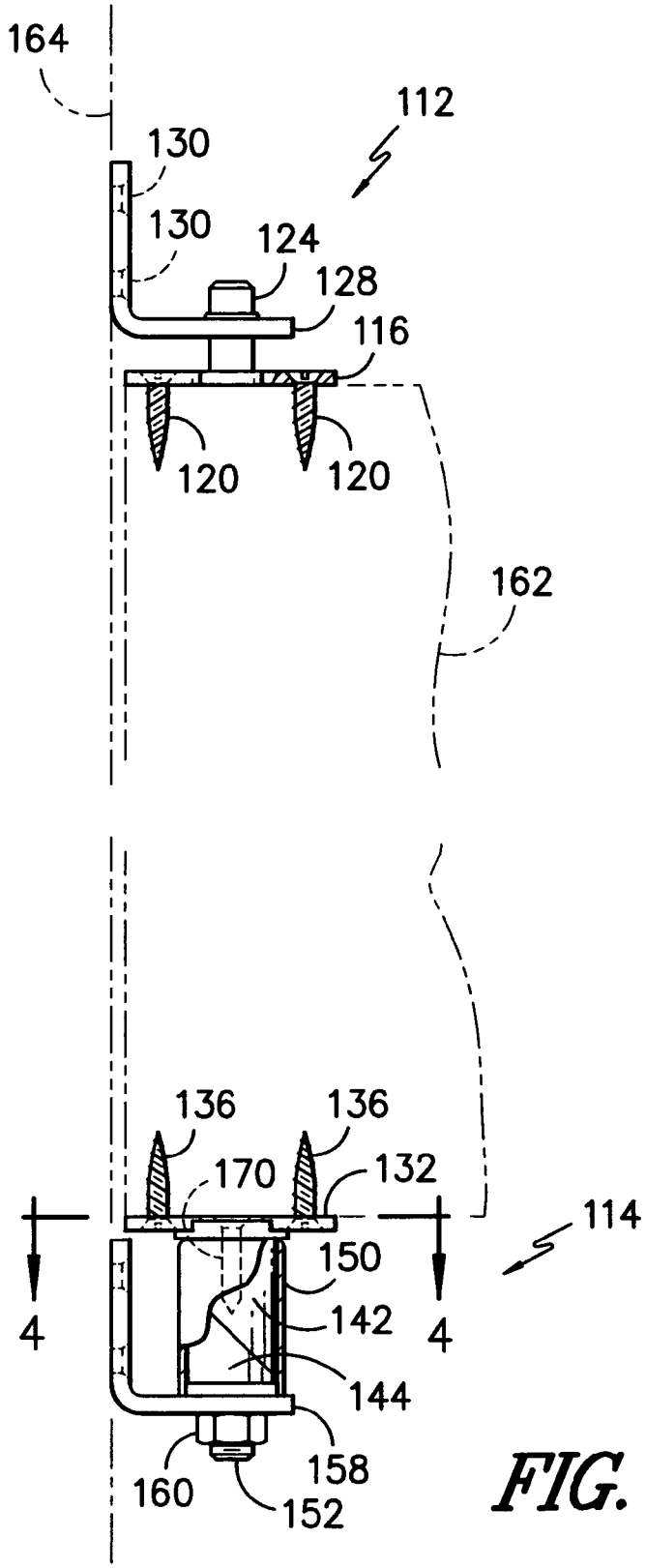
FIG. 3 is a partially cut-away view of the hinge assembly of FIG. 2 in an installed position relative to a door and supporting wall shown in phantom.

Looking now to FIGS. 2 and 3 an exemplary hinge assembly 110 is illustrated. In these figures, elements corresponding to those previously described in relation to the prior art are designated by like reference numerals increased by 100. As illustrated, according to the exemplary and potentially preferred embodiment, the upper pivot portion 112 may be formed in substantially the same configuration as the upper pivot portion 12 of the prior art assembly illustrated and described in reference to FIG. 1. However, according to a potentially preferred practice, the bushing 126 is a solid bushing rather than a split bushing. As will be appreciated, this upper pivot portion 112 forms an operative connection between an upper portion of a door 162 and a wall or other stationary support 164.

According to the illustrated construction, the lower pivot portion 114 utilizes a construction which eliminates the need for an axial rod or pintle to maintain the axial alignment of the rotating cam cylinder 142 and the stationary cam cylinder 144. In addition, in the illustrated construction the need for lock washers to hold the stationary cam cylinder 144 in place has been eliminated.

As shown, in the illustrated arrangement, the rotating cam cylinder 142 is preferably secured in fixed axial and rotational position relative to the lower connection plate 132. That is, the rotating cam cylinder 142 is held in position against the lower connection plate 132 and cannot rotate relative to the lower connection plate 132. According to the potentially preferred practice, in order to establish and retain this relative stability between the connection plate 132 and the rotating cam cylinder 142, a screw 170 or other attachment device is extended through an opening within the connection plate 132 and into the body of the rotating cam cylinder 142.

Figure 4:
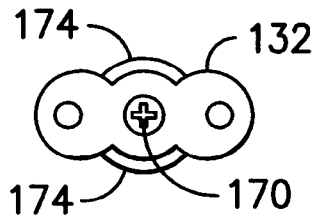
FIG. 4 is a view illustrating an exemplary interlocking seated relationship between a rotatable cam cylinder and a hinge door connection plate taken generally along line 4—4 in FIG. 3.

In order to provide further stability, it is contemplated that the lower connection plate 132 will, itself be configured so as to be seated in anti-rotational relation to the upper portion of the rotating cam cylinder 42. One exemplary configuration for such a seated configuration is illustrated through simultaneous reference to FIGS. 2–4. As shown in this arrangement, the upper portion of the rotating cam cylinder 142 is provided with a pattern of discontinuous raised walls 174 which form a depression into which a central portion of the connection plate 132 holding the attachment screw 170 may be inserted in a seated relation. As illustrated, the geometry of the portion of the connection plate 132 which is seated between the walls 174 is preferably such that substantial independent rotation is prevented. That is, preferably the connection plate 132 and the raised walls 174 engage one another in a substantially gear-like manner such that rotation of one is translated to the other.

In the illustrated embodiment the connection plate 132 has a substantially scalloped edge profile so as to form a tri-lobal plan geometry thereby facilitating mating the interior with the substantially circular seating depression defined by the discontinuous walls 174. However, virtually any other complementary geometry may also be used. Preferably, the height of the walls 174 is approximately equal to the thickness of the connection plate 132 so as to provide an essentially flat contact surface with the lower edge of the door 172. Surprisingly, it has been found that the combination of the screw attachment and depression seated connection plate 132 relative to the rotating cam cylinder 142 provides excellent long-term positional stability of the rotating cam cylinder 142 along a fixed axis of rotation even in the absence of a central pintle element.

Figure 5:
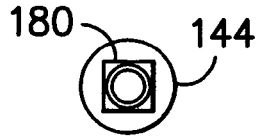
FIG. 5 is a view illustrating an integral anti-rotation nipple disposed across the underside of a stationary cam surface as viewed generally along line 5—5 in FIG. 2.

According to the illustrated and potentially preferred embodiment, the fixed rotational and axial position of the stationary cam cylinder 144 is preferably maintained by a fitted geometric complementary relation between a polygonal base portion 180 of the threaded nipple 152 and a nipple acceptance opening 182 within the lower pivot bracket 158. Thus, the acceptance opening within the lower pivot bracket will preferably have substantially the same size and shape as the base portion 180 of the nipple 152. By way of example only, and not limitation, an exemplary plan view of the threaded nipple extending away from the underside of the rotating cam cylinder 144 with a square base portion 180 is illustrated in FIG. 5. Of course, any other suitable geometry for the base portion 180 may be utilized which prohibits rotation relative to the pivot bracket 158. A complementary nut 160 which engages the threaded portion of the nipple serves to lock the stationary cam cylinder 144 in place against undesired axial movement. Such an arrangement eliminates the need for separate lock washers.

The elimination of axial rods or pintles to provide relative alignment of the cam cylinders 142, 144 avoids the need for complex tapping of pintle acceptance openings. Thus, if desired, the cam cylinders may be substantially solid with flat planar contacting surfaces. Of course, the cam cylinders may also have other constructions such as a cup-shaped structure wherein the rim acts as the camming surface as will be well known to those of skill in the art.

In addition to the elimination of the need to tap pintle acceptance openings, the elimination of the rigid axial alignment element (which is typically formed from hardened metal) extending between the cam cylinders may also enhance the ability to use non-metallic materials of construction to form one or both cam cylinders. In the present instance, applicants have found that suitable polymeric materials such as nylon or the like may be used to form one or both cam cylinders. Of course other materials including other polymers and/or metals suitable for use in a given environment may be used if desired. In the event that a polymeric is utilized in one or both cam cylinders, according to one potentially preferred practice, such materials may be infused with a self-activating lubricant material such as graphite, molybdenum or the like which is activated by friction between the cam surfaces. Such self-lubrication substantially eliminates the need for the introduction of lubricants during use and thereby promotes the overall lifespan of the structure.

As will be appreciated, while the present invention has been illustrated and described in relation to various potentially preferred embodiments, constructions, and procedures, it is to be understood that such embodiments, constructions, and procedures are illustrative only and that the present invention is in no event to be limited thereto. Rather, it is contemplated that modifications and variations embodying the principles of the invention will no doubt occur to those of skill in the art to which the invention pertains. Therefore, it is contemplated and intended that the present invention shall extend to all such modifications and variations as may incorporate the broad principles of the invention within the full spirit and scope thereof.

The invention claimed is:

1. A gravity hinge assembly for a swinging door, the gravity hinge assembly comprising:

a rotating cam cylinder including a head portion at a first end and a first angled cam surface at a second end, wherein the head portion of the rotating cam cylinder includes a discontinuous raised wall portion defining a seating depression across the head portion;

a stationary cam cylinder including a projecting nipple at a first end and a second angled cam surface at a second end, wherein a cross-section of at least one of the rotating cam cylinder and the stationary cam cylinder is continuous, the cross-section being a plane parallel to at least one of the first and second angled cam surface;

a connection plate adapted to translate rotation of the door to the rotating cam cylinder, wherein the connection plate includes an interior portion configured in mating relation to the seating depression across the head portion of the rotating cam cylinder such that upon seating the interior portion of the connection plate within the seating depression, the connection plate is substantially prevented from axial rotation relative to the rotating cam cylinder; and a wall mounting bracket including a nipple acceptance opening disposed through a leg projecting away from a mounting wall and adapted to accept the nipple projecting from the stationary cam cylinder.

2. The invention as recited in claim 1, wherein the rotating cam cylinder and the stationary cam cylinder are not connected to one another.

3. The invention as recited in claim 1, wherein at least one of the rotating cam cylinder and the stationary cam cylinder comprises a polymeric material.

4. The invention as recited in claim 3, wherein said polymeric material is nylon.

5. The invention as recited in claim 3, wherein said polymeric material includes a friction activated lubricant such that said polymeric material is self lubricating.

6. The invention as recited in claim 5, wherein said friction activated lubricant is molybdenum.

7. The invention as recited in claim 1, further including a wall mounting bracket and wherein the stationary nipple at the first end of the stationary cam cylinder includes a threaded portion projecting away from a polygonal base portion, the polygonal base portion being adapted to fit in anti-rotational relation within an opening across a leg of the wall mounting bracket.

8. The invention as recited in claim 7, wherein the polygonal base portion is square.

9. The invention as recited in claim 1, wherein the connection plate has a scalloped perimeter defining a substantially tri-lobal geometry.

10. A gravity hinge assembly for a swinging door, the gravity hinge assembly comprising:

a rotating cam cylinder including a head portion at a first end and a first angled cam surface at a second end, wherein the head portion of the rotating cam cylinder includes a discontinuous raised wall portion defining a seating depression across the head portion;

a stationary cam cylinder including a projecting nipple at a first end and a second angled cam surface at a second end;

a connection plate adapted to translate rotation of the door to the rotating cam cylinder, wherein the connection plate includes an interior portion configured in mating relation to the seating depression across the head portion of the rotating cam cylinder such that upon seating the interior portion of the connection plate within the seating depression, the connection plate is substantially prevented from axial rotation relative to the rotating cam cylinder; and a wall mounting bracket including a nipple acceptance opening disposed through a leg projecting away from a mounting wall, and wherein the nipple at the first end of the stationary cam cylinder includes a threaded portion projecting away from a polygonal base portion, the threaded portion being sized to move freely through the nipple acceptance opening and the polygonal base portion being adapted to fit in anti-rotational relation within the nipple acceptance opening.

11. The invention as recited in claim 10, wherein the rotating cam cylinder and the stationary cam cylinder are not connected to one another.

12. The invention as recited in claim 10, wherein at least one of the rotating cam cylinder and the stationary cam cylinder comprises a polymeric material.

13. The invention as recited in claim 12, wherein said polymeric material is nylon.

14. The invention as recited in claim 12, wherein said polymeric material includes a friction activated lubricant such that said polymeric material is self lubricating.

15. The invention as recited in claim 14, wherein said friction activated lubricant is molybdenum.

16. The invention as recited in claim 1, wherein the connection plate has a scalloped perimeter defining a substantially tri-lobal geometry.

17. A gravity hinge assembly for a swinging door, the gravity hinge assembly comprising:

a self lubricating polymeric rotating cam cylinder including a head portion at a first end and a first angled cam surface at a second end, wherein the head portion of the rotating cam cylinder includes a discontinuous raised wall portion defining a substantially circular seating depression across the head portion;

a self lubricating polymeric stationary cam cylinder including a projecting nipple at a first end and a second angled cam surface at a second end wherein the nipple at the first end of the stationary cam cylinder includes a threaded portion projecting away from a polygonal base portion;

a tri-lobal connection plate adapted to translate rotation of the door to the rotating cam cylinder, wherein the connection plate includes an interior portion configured in mating relation to the seating depression across the head portion of the rotating cam cylinder such that upon seating the interior portion of the connection plate within the seating depression, the connection plate is substantially prevented from axial rotation relative to the rotating cam cylinder; and a wall mounting bracket including a nipple acceptance opening disposed through a leg projecting away from a mounting wall and adapted to accept the nipple projecting from the stationary cam cylinder.

* * * * *